US007857656B2

(12) United States Patent
Tai et al.

(10) Patent No.: US 7,857,656 B2
(45) Date of Patent: Dec. 28, 2010

(54) ELECTRICAL CONNECTOR AND ELECTRICAL CONNECTOR ASSEMBLY HAVING HEAT-RADIATING STRUCTURE

(75) Inventors: Hung-Chi Tai, Jhonghe (TW); Yung-Chih Hung, Jhonghe (TW)

(73) Assignee: Alltop Electronics (Suzhou) Co., Ltd., Jiangsu Province (CN)

( * ) Notice: Subject to any disclaimer, the term of this patent is extended or adjusted under 35 U.S.C. 154(b) by 0 days.

(21) Appl. No.: 12/508,059

(22) Filed: Jul. 23, 2009

(65) Prior Publication Data

US 2010/0273347 A1 Oct. 28, 2010

(30) Foreign Application Priority Data

Apr. 24, 2009 (CN) ..... 2009 1 0137985

(51) Int. Cl.
*H01R 13/00* (2006.01)

(52) U.S. Cl. ..... 439/485; 439/487

(58) Field of Classification Search ..... 439/485, 439/486, 487, 374

See application file for complete search history.

(56) References Cited

U.S. PATENT DOCUMENTS 7,275,966 B2 * 10/2007 Poh et al. ..... 439/636
7,452,249 B2 * 11/2008 Daily et al. ..... 439/825
7,458,839 B2 * 12/2008 Ngo et al. ..... 439/291
7,597,573 B2 * 10/2009 Defibaugh et al. ..... 439/206
7,666,025 B2 * 2/2010 Cheng et al. ..... 439/485
2003/0219999 A1 * 11/2003 Minich et al. ..... 439/79
2006/0035521 A1 * 2/2006 Ngo et al. ..... 439/608

* cited by examiner

*Primary Examiner*—Hae Moon Hyeon
(74) *Attorney, Agent, or Firm*—Sughrue Mion, PLLC

(57) ABSTRACT

An electrical connector for electrically connecting with a complementary connector includes an insulative housing defining a number of contact-receiving passages, and a number of conductive contacts respectively received in the contact-receiving passages adapted for electrically connecting with conductive contacts of the complementary connector and generating heat. The insulative housing defines a pair of first heat-radiating channels located at opposite lateral sides thereof and extending through the insulative housing along a mating direction, and at least one second heat-radiating channel extending through the insualtive housing along the mating direction and located between at least a pair of contact-receiving passages adjacent thereto. The heat generated by the conductive contacts is capable of radiated out of the insualtive housing through the first heat-radiating channels and the at least one second heat-radiating channel.

12 Claims, 6 Drawing Sheets

ELECTRICAL CONNECTOR AND ELECTRICAL CONNECTOR ASSEMBLY HAVING HEAT-RADIATING STRUCTURE

BACKGROUND OF THE INVENTION

1. Field of the Invention

The present invention relates to an electrical connector and an electrical connector assembly, more particularly to an electrical connector and an electrical connector assembly having heat-radiating structures.

2. Description of Related Art

Electrical connectors are widely used today. In general, electrical connectors can be classified as desktop connectors, laptop connectors, mobile phone connectors, consuming connectors, and other types. Power connector is one common kind electrical connector used in different equipments. Usually, a plug-type power connector and a receptacle-type power connector mate with each other to supply power to equipments. Contacts of the plug and the receptacle contact one another to form electrical connection. However, because of impedance of contacts, heat is generated and is not easy to be radiated out of the connectors. If the heat cannot be radiated out of the connectors in time, the heat accumulated in the connectors may cause different problems. For example, contacting portions of the contacts may produce carbon, melt, and excessive deformation etc. The insulative housing also may produce deformation, melt etc. Such phenomenon all can produce influence to reliability of power transmission and use life of the power connectors.

Hence, it is disable to design an electrical connector to address problems mentioned above.

BRIEF SUMMARY OF THE INVENTION

Accordingly, an object of the present invention is to provide an electrical connector with improved heat-radiating structures.

Another object of the present invention is to provide an electrical connector assembly with improved heat-radiating structures.

In order to achieve the above-mentioned object, an electrical connector for electrically connecting with a complementary connector comprises an insulative housing defining a plurality of contact-receiving passages, and a plurality of conductive contacts respectively received in the contact-receiving passages adapted for electrically connecting with conductive contacts of the complementary connector and generating heat. The insulative housing defines a pair of first heat-radiating channels located at opposite lateral sides thereof and extending through the insulative housing along a mating direction, and at least one second heat-radiating channel extending through the insualtive housing along the mating direction and located between at least a pair of contact-receiving passages adjacent thereto. The heat generated by the conductive contacts is capable of radiated out of the insualtive housing through the first heat-radiating channels and the at least one second heat-radiating channel.

In order to achieve the above-mentioned object, an electrical connector assembly comprises a first connector and a second connector mating with the first connector. The first connector comprises a first insualtive housing defining a plurality of contact-receiving passages, and a plurality of first conductive contacts received in the contact-receiving passages of the first insulative housing. The first insulative housing defines a pair of first heat-radiating channels located at opposite lateral sides thereof and extending through the first insulative housing along a mating direction, and at least one second heat-radiating channel extending through the first insualtive housing along the mating direction and located between at least a pair of contact-receiving passages adjacent thereto. The second connector comprises a second insulative housing defining a plurality of contact-receiving passages, and a plurality of second conductive contacts received in the contact-receiving passages of the second insulative housing. The second insulative housing defines a pair of first heat-radiating passages located at opposite lateral sides thereof and extending therethrough along the mating direction, and at least one second heat-radiating passage extending through the second insulative housing along the mating direction and located between at least a pair of contact-receiving passages adjacent thereto. After the first and second connectors mate with each other, the first and second conductive contacts in electrical connection status generate heat. The first heat-radiating channels align with and communicate with the first heat-radiating passages. The second heat-radiating channel aligns with and communicates with the second heat-radiating passage. The heat generated by the first and second conductive contacts is capable of being radiated out of the first and second insulative housings via flowing through the first and second heat-radiating channels and first and second heat-radiating passages.

The foregoing has outlined rather broadly the features and technical advantages of the present invention in order that the detailed description of the invention that follows may be better understood. Additional features and advantages of the invention will be described hereinafter, which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
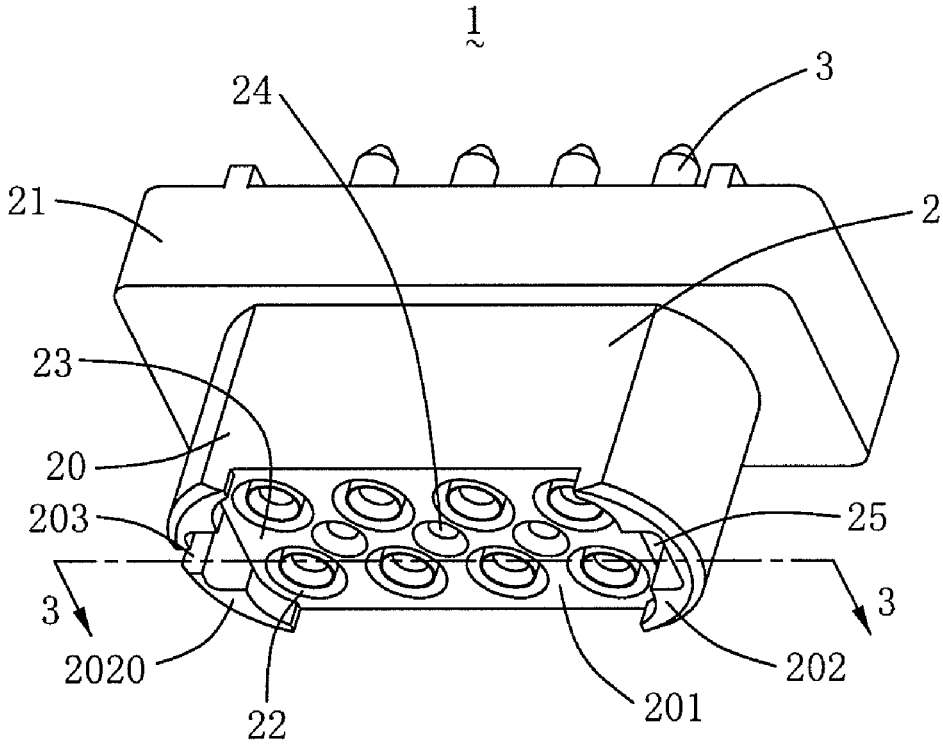
FIG. 1 is an assembled, perspective view of a first connector (electrical connector) in accordance with the present invention.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Reference will be made to the drawing figures to describe the present invention in detail, wherein depicted elements are not necessarily shown to scale and wherein like or similar elements are designated by same or similar reference numeral through the several views and same or similar terminology.

Figure 2:
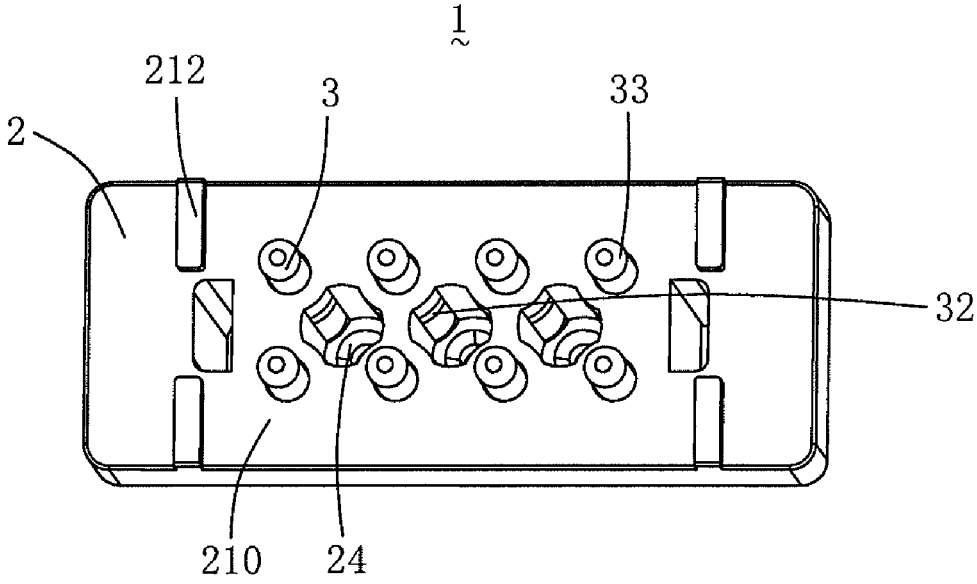
FIG. 2 is a view similar to FIG. 1, but viewed from a different aspect.
Figure 3:
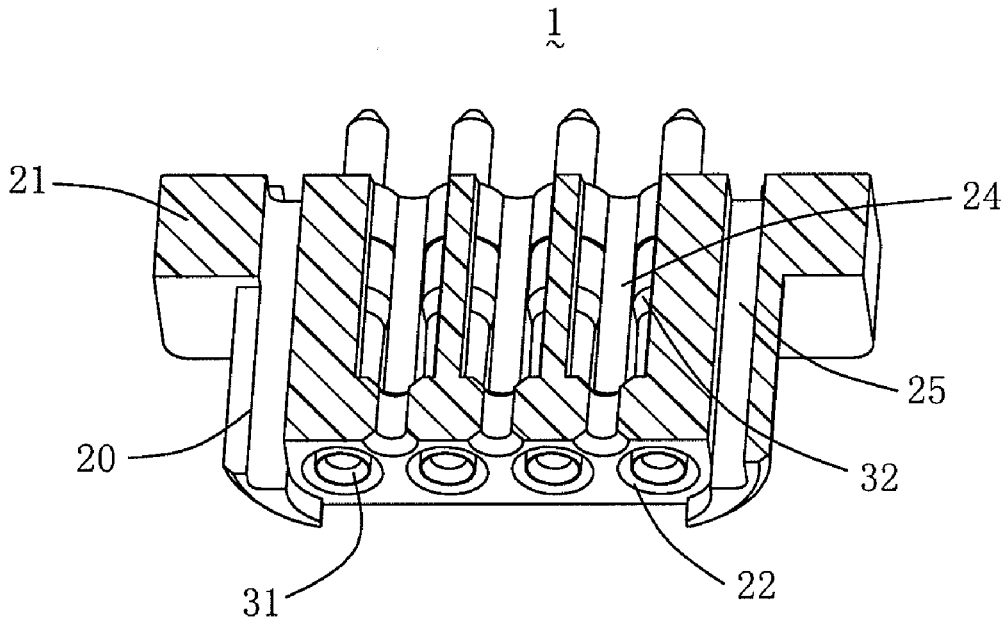
FIG. 3 is a cross-sectional view of the first connector taken along line 3-3 of FIG. 1.

Referring to FIGS. 1-3, a first connector 1 in accordance with a preferred embodiment of the present invention is shown. In the preferred embodiment, the first connector 1 is a receptacle connector. As shown in FIG. 1, the first connector 1 comprises a first insulative housing 2 and a plurality of first conductive contacts 3 assembled in the first insulative housing 2. In the preferred embodiment, there are eight first conductive contacts 3. The first connector 1 is a power type connector for power transmission in the preferred embodiment of the present invention. However, in an alternative embodiment of the present invention, the first connector 1 is not restricted to a power type connector.

In the preferred embodiment, the first insulative housing 2 comprises a rectangular first base portion 21 and a first mating portion 20 extending forwardly from middle of a front surface of the first base portion 21. A front surface 201 of the first mating portion 20 is of elliptic shape. Two rows of contact-receiving passages 22 in upper and lower relationship penetrate from the front surface 201 of the first mating portion 20 to a rear surface 210 of the first base portion 21 of the first insualtive housing 2. A pair of arc-shape protrusions 202 extends forwardly from opposite lateral sides of the front surface 201 and each forms a contacting surface 2020 for contacting with a second connector 4. The arc-shape protrusions 202 also can be treated as being recessed from the front surface 201 of the first mating portion 20.

Now, heat-radiating structures of the first connector 1 will be introduced in detail. The heat-radiating structures comprise a third heat-radiating channel 23, and first and second heat-radiating channels 25, 24 which respectively communicate with the third heat-radiating channel 23. The third heat-radiating channel 23 is defined by the front surface 201 of the first mating portion 20 and the pair of protrusions 202. The second heat-radiating channels 24 penetrate from the front surface 201 of the first mating portion 20 to the rear surface 210 of the first base portion 21. In the preferred embodiment, there are three second heat-radiating channels 24. If we define an upper contact-receiving passage 22 and a lower contact-receiving passage 22 as one group, then, each second heat-radiating channel 24 is located between two groups of aligned upper and lower contact-receiving passages 22. Please refer to FIG. 2 in particular, each second heat-radiating channel 24 communicates with the four contact-receiving passages 22 of the two groups. The first heat-radiating channels 25 are of rectangular shape and penetrate from the contacting surfaces 2020 of the protrusions 202 to the rear surface 210 of the first base portion 21. A slot 203 for preventing from mating wrongly with the second connector 4 is defined through the left lateral wall of the first mating portion 20. A pair of standoffs 212 is formed on the rear surface 210 of the first base portion 21 and locates adjacent to upper and lower sides of the first heat-radiating channels 25 for supporting the first insualtive housing 2 on a printed circuit board (not shown) and also for heat radiation.

Figure 8:
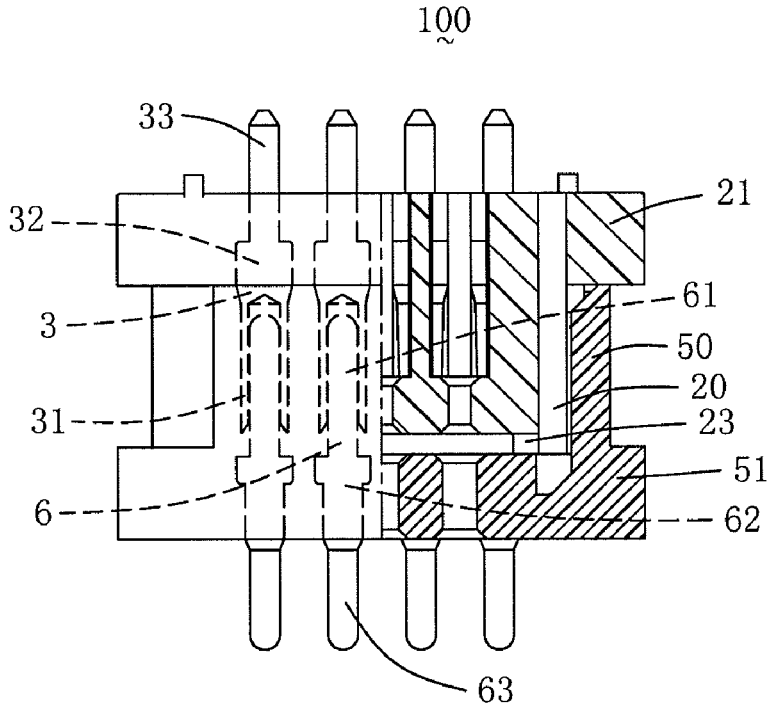
FIG. 8 is a cross-sectional view of the electrical connector assembly taken along line 8-8 of FIG. 7.
Figure 9:
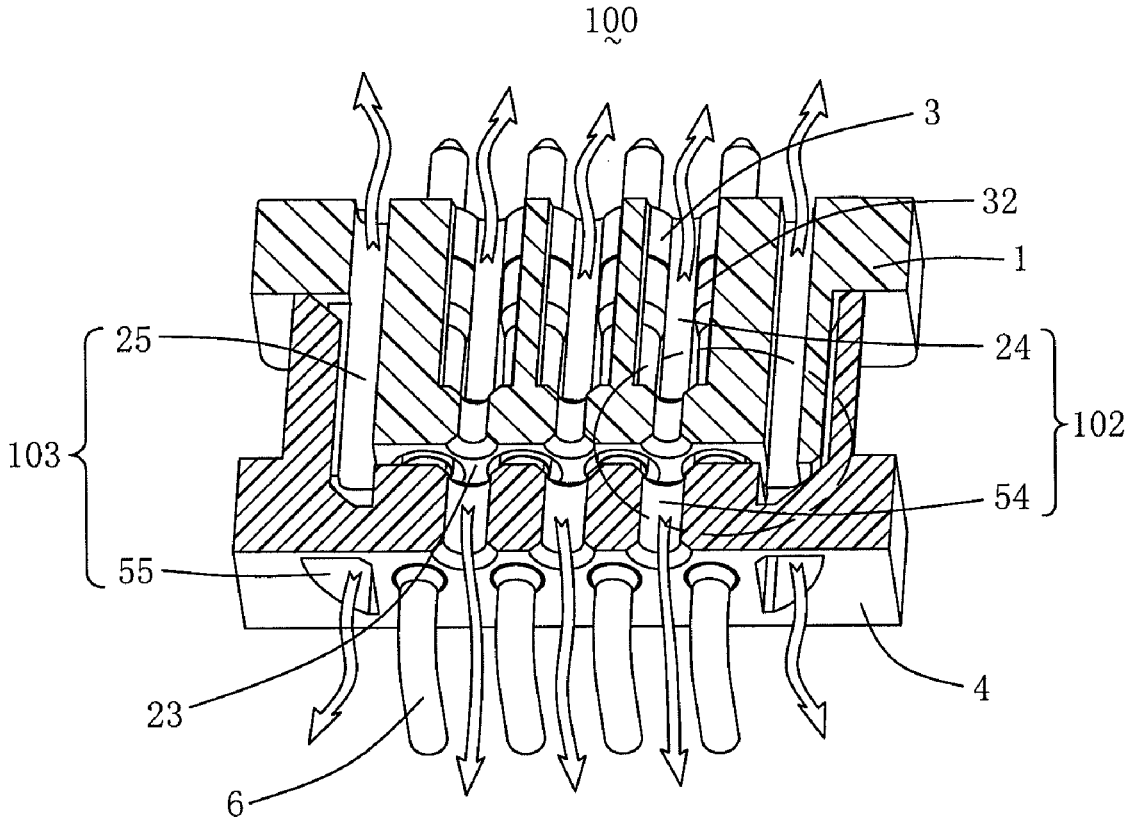
FIG. 9 is a cross-sectional view of the electrical connector assembly taken along line 9-9 of FIG. 7.
Figure 10:
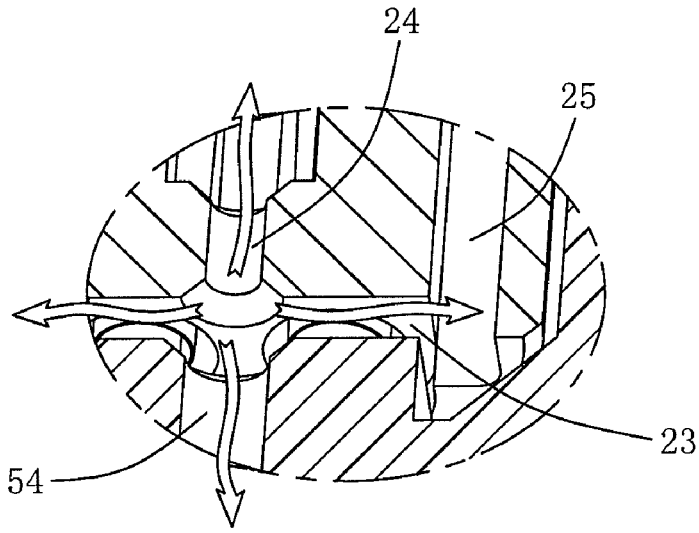
FIG. 10 is an enlarged view of the circled part in FIG. 9 which illustrates the heat-radiating paths clearly.
Figure 11:
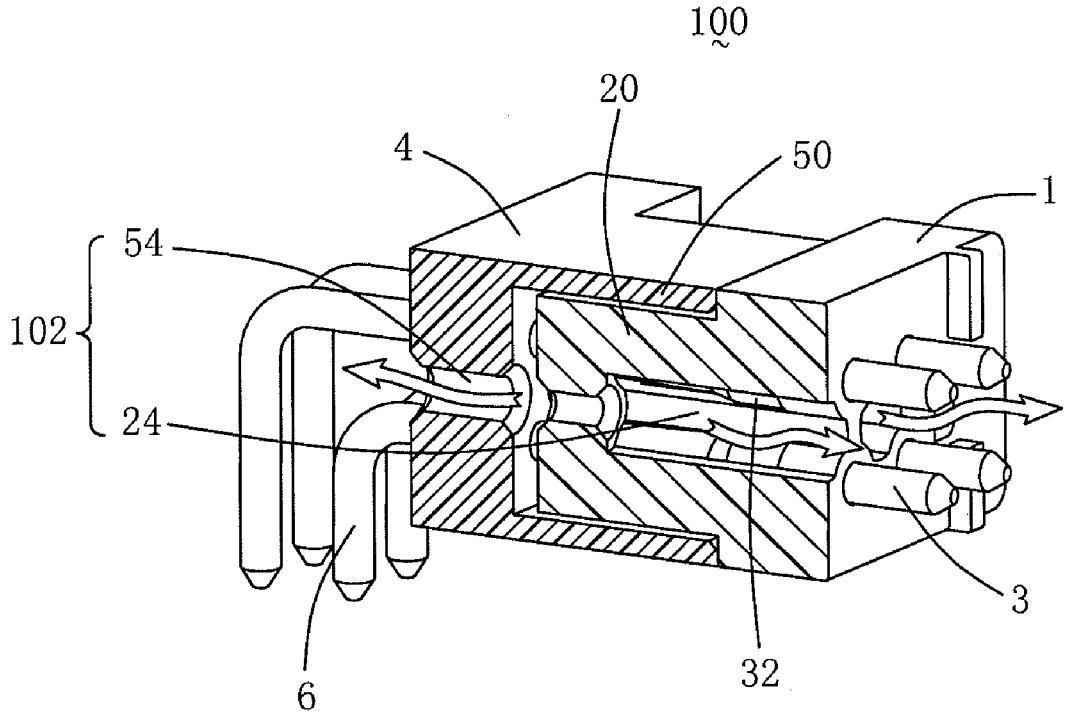
FIG. 11 is a cross-sectional view of the electrical connector assembly taken along line 11-11 of FIG. 7.
Figure 12:
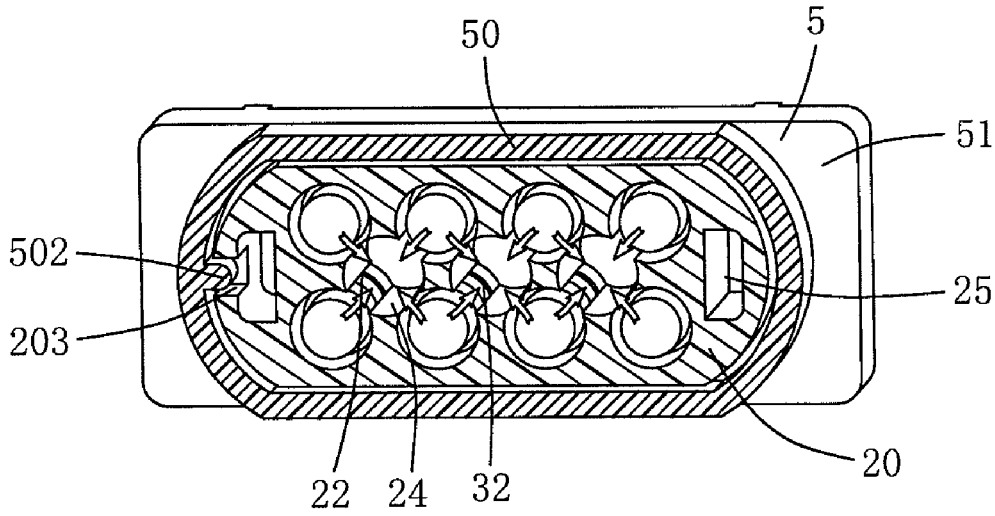
FIG. 12 is a cross-sectional view of the electrical connector assembly taken along line 12-12 of FIG. 7.

In combination with FIG. 8, each first conductive contact 3 comprises a first mating section 31 received in a front section of the contact-receiving passage 22, a first retaining section 32 interferentially received in a rear section of the contact-receiving passage 22, and a first mounting section 33 extending rearward from the first retaining section 32 and beyond the rear surface 210 of the first base portion 21. Please refer to FIG. 2, because the second heat-radiating channel 24 communicates with four adjacent contact-receiving passages 22, the first retaining sections 32 of the first conductive contacts 3 are partially exposed into the second heat-radiating channel 24. Therefore, better heat radiating effect can be achieved.

Figure 4:
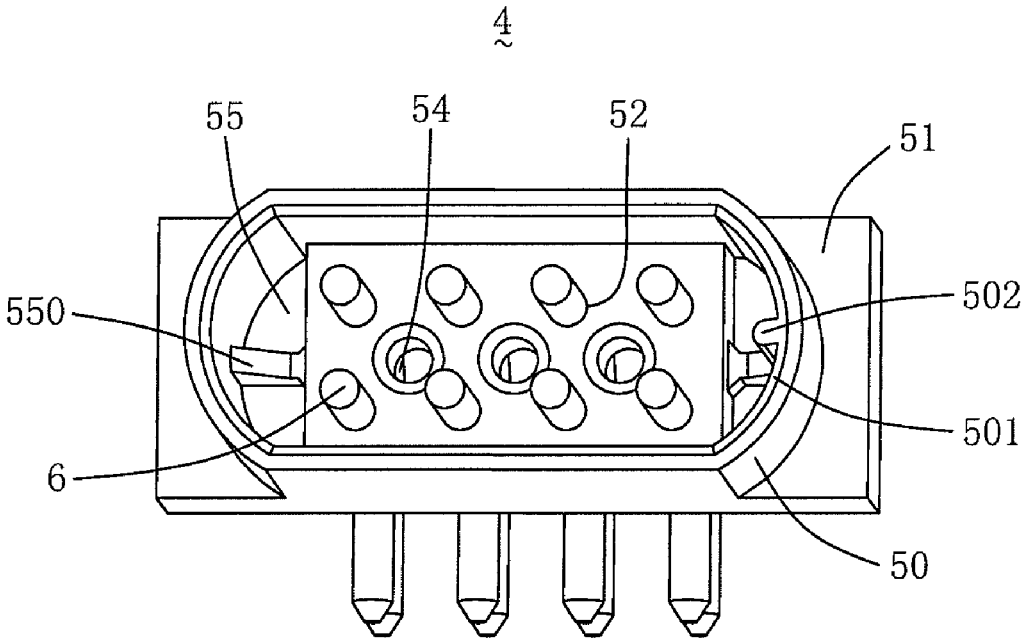
FIG. 4 is an assembled, perspective view of a second connector (electrical connector) in accordance with the present invention.
Figure 5:
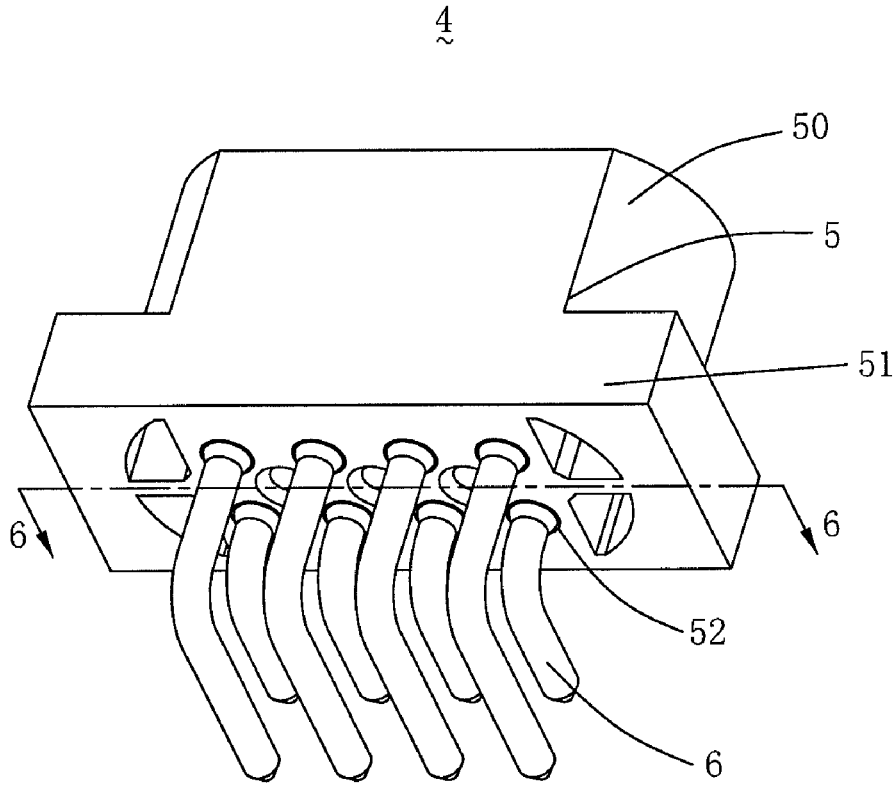
FIG. 5 is a view similar to FIG. 4, but viewed from a different aspect.
Figure 6:
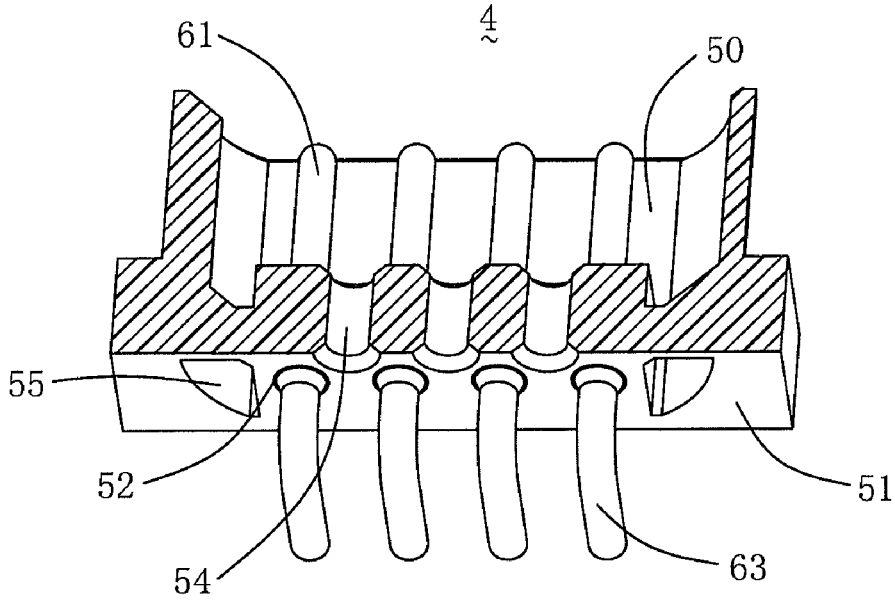
FIG. 6 is a cross-sectional view of the second connector taken along line 6-6 of FIG. 5.
Figure 7:
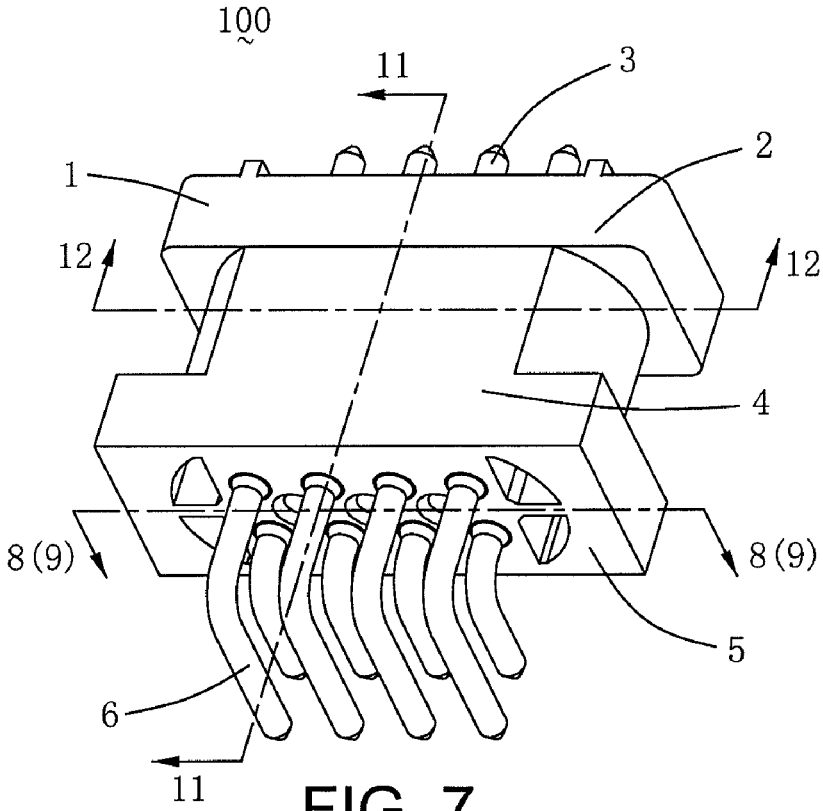
FIG. 7 is an assembled, perspective view of an electrical connector assembly in accordance with the present invention.

Referring to FIGS. 4-6, the second connector 4 in accordance with a preferred embodiment of the present invention is shown. In the preferred embodiment, the second connector 4 is a plug connector. As shown in FIG. 4, the second connector 4 comprises a second insulative housing 5 and a plurality of second conductive contacts 6 assembled to the second insulative housing 5. In the preferred embodiment, there are eight second conductive contacts 6. The second connector 4 is a power type connector for power transmission in the preferred embodiment of the present invention. However, in an alternative embodiment of the present invention, the second connector 4 is not restricted to a power type connector.

The second insulative housing 5 comprises a rectangular second base portion 51 and a second mating portion 50 of elliptic-shape and extending from a rear surface of the second base portion 51. The second insulative housing 5 defines two rows of contact-receiving passages 52 in upper and lower relationship which penetrate through the second base portion 51. The second mating portion 50 comprises a mating surface 501 contacting the contacting surface 2020 of the first insualtive housing 2. A rib 502 is formed in the inner surface of a right side wall of the second mating portion 50 and extends along front-to-back direction for mating with the slot 203 of the first insualtive housing 2 to prevent from wrong cooperation between the second and first connectors 4, 1.

Now, heat-radiating structures of the second connector 4 will be introduced in detail. The second connector 4 comprises a pair of first heat-radiating passages 55 and three second heat-radiating passages 54. The second heat-radiating passages 54 penetrate through the second base portion 51 along front-to-back direction and each is located between two groups of aligned contact-receiving passages 52 (the group has the same meaning as in the first connector 1). The first heat-radiating passages 55 are located at left and right lateral sides of the second base portion 51 and penetrate through the second base portion 51 along front-to-back direction. A pair of ribs 550 is disposed in the second base portion 51 to separate each first heat-radiating passage 55 into upper and lower halves.

In combination with FIG. 8, the second conductive contact 6 comprises a second mating section 61 exposed into the second mating portion 50, a second retaining section 62 interferentially received in the contact-receiving passage 52, and an L-shape second mounting section 63 extending from the second retaining section 62 and exposed beyond a rear surface of the second base portion 51.

Please refer to FIGS. 7-12, an electrical connector assembly 100 in accordance with the present invention is formed by mated first and second connectors 1, 4. What should be pointed out is the first and second connectors 1, 4 are the electrical connectors in accordance with the present invention. When mated, the first mating portion 20 of the first insualtive housing 2 is inserted into the second mating portion 50 of the second insualtive housing 5 until the mating surface 501 of the second mating portion 50 abuts against the front surface of the first base portion 21 with the second mating sections 61 of the second conductive contacts 6 inserted into the first mating sections 31 of the first conductive contacts 3 to form electrical connection. Please refer to FIGS. 6-12 in particular, the electrical connector assembly 100 comprises a pair of first heat-radiating passageways 103 formed by the first heat-radiating channels 25 and the first heat-radiating passages 55 which are aligned with and communicate with one another, three second heat-radiating passageways 102 formed by the second heat-radiating channels 24 and the second heat-radiating passages 54 which are aligned with and communicate with one another, and the third heat-radiating passageway/channel 23.

Therefore, after the first and second connectors 1, 4 form electrical connection therebetween, the first and second conductive contacts 3, 6 begin to product heat. The heat can be radiated to the outside in time (referring to arrow directions) through the first, second and third heat-radiating passageways 103, 102, 23. The temperature of the first and second insulative housing 2, 5 and the first and second conductive contacts 3, 6 can be decreased effectively. Please refer to FIG. 10, according to the directions indicated by the arrows, the heat flows from the third heat-radiating passageways 23 toward the first and second heat-radiating passageways 103, 102 and is led out by the first and second heat-radiating passageways 103, 102. Please refer to FIG. 12 specially, since the contact-receiving passages 22 communicate with the second heat-radiating channels 24 partially, the heat generated by the first and second conductive contacts 3, 6 also can be guided out from the contact-receiving passages 22 to the second heat-radiating channels 24 then to outside. At the same time, the first conductive contacts 3 partially exposed in the second heat-radiating channels 24 can be heat-radiated more effectively thus temperatures thereof can be decreased significantly.

The existence of these heat-radiating passageways 102, 103, 23 are capable of not only radiating heat effectively to prevent the insualtive housings 2, 5 and the conductive contacts 3, 6 from producing different kinds of problems, but also assuring rigidity of the insulative housings 2, 5.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. For example, the tongue portion is extended in its length or is arranged on a reverse side thereof opposite to the supporting side with other contacts but still holding the contacts with an arrangement indicated by the broad general meaning of the terms in which the appended claims are expressed.

We claim:

1. An electrical connector adapted for electrically connecting with a complementary connector, comprising:

an insulative housing defining a plurality of contact-receiving passages, a pair of first heat-radiating channels located at opposite lateral sides thereof and extending through the insulative housing along a mating direction, and at least one second heat-radiating channel extending through the insulative housing along said mating direction and located between at least a pair of contact-receiving passages adjacent thereto; and a plurality of conductive contacts respectively received in said contact-receiving passages adapted for electrically connecting with conductive contacts of the complementary connector and generating heat; and wherein the heat generated by the conductive contacts is capable of radiated out of the insulative housing through the first heat-radiating channels and the at least one second heat-radiating channel.

2. The electrical connector as claimed in claim 1, wherein the at least one second heat-radiating channel communicates with the adjacent contact-receiving passages, and wherein the contacts received in said contact-receiving passages are partially exposed into the at least one second heat-radiating channel for heat radiation.

3. The electrical connector as claimed in claim 1, wherein the insulative housing defines two rows of contact-receiving passages, and wherein the at least one second heat-radiating channel is located adjacent four contact-receiving passages.

4. The electrical connector as claimed in claim 3, wherein the at least one second heat-radiating channel communicates with said four contact-receiving passages, and wherein four contacts received in the contact-receiving passages are partially exposed into the at least one heat-radiating channel.

5. The electrical connector as claimed in claim 4, wherein there are a pair of second heat-radiating channels, and wherein each contact is partially exposed into the pair of second heat-radiating channels.

6. The electrical connector as claimed in claim 1, wherein the insulative housing comprises a base portion and a mating portion extending forwardly from the base portion, and wherein the first and second heat-radiating channels penetrate through both the base portion and the mating portion.

7. The electrical connector as claimed in claim 1, the insulative housing comprises a base portion and a mating portion extending forwardly from the base portion, the mating portion is partially cutoff along the mating direction to form a front contacting surface and a front surface behind the front contacting surface, and wherein a third heat-radiating channel is defined between the contacting surface and the front surface, and wherein the third heat-radiating channel communicates with both the first heat-radiating channels and the second heat-radiating channel.

8. The electrical connector as claimed in claim 7, wherein the first and second heat-radiating channels penetrate through both the base portion and the mating portion.

9. The electrical connector as claimed in claim 1, wherein the electrical connector is a power type connector for power transmission.

10. An electrical connector assembly comprising:

a first connector comprising:

a first insulative housing defining a plurality of contact-receiving passages, a pair of first heat-radiating channels located at opposite lateral sides thereof and extending through the first insulative housing along a mating direction, and at least one second heat-radiating channel extending through the first insulative housing along said mating direction and located between at least a pair of contact-receiving passages adjacent thereto; and a plurality of first conductive contacts received in the contact-receiving passages of the first insulative housing;

a second connector comprising:

a second insulative housing defining a plurality of contact-receiving passages, a pair of first heat-radiating passages located at opposite lateral sides thereof and extending therethrough along said mating direction, and at least one second heat-radiating passage extending through the second insulative housing along said mating direction and located between at least a pair of contact-receiving passages adjacent thereto; and a plurality of second conductive contacts received in the contact-receiving passages of the second insulative housing; and wherein after the first and second connectors mate with each other, the first and second conductive contacts in electrical connection status generate heat, the first heat-radiating channels align with and communicate with the first heat-radiating passages, the second heat-radiating channel aligns with and communicates with the second heat-radiating passage; and wherein the heat generated by the first and second conductive contacts is capable of being radiated out of the first and second insulative housings via flowing through the first and second heat-radiating channels and first and second heat-radiating passages.

11. The electrical connector assembly as claimed in claim 10, wherein the first connector further defines a third heat-radiating channel adjacent to a contacting surface contacting the second connector, and wherein the third heat-radiating channel communicates with the first and second heat-radiating channels and the first and second heat-radiating passages.

12. The electrical connector assembly as claimed in claim 10, wherein the second heat-radiating channel communicates with the adjacent contact-receiving passages of the first insulative housing, and wherein the first conductive contacts are partially exposed into the second heat-radiating channel.

* * * * *